US005868971A

United States Patent [19]

Meyer

[11] Patent Number: 5,868,971

[45] Date of Patent: Feb. 9, 1999

[54] DEVICE FOR INTRODUCING GASES INTO LIQUIDS IN FINE BUBBLES

[75] Inventor: Udo Meyer, Baden, Austria

[73] Assignee: Dipl.-Ing. Udo Meyer Aquaconsult Ges. M.B.H., Baden, Austria

[21] Appl. No.: 750,465

[22] PCT Filed: Jun. 14, 1995

[86] PCT No.: PCT/AT95/00118

§ 371 Date: Mar. 25, 1997

§ 102(e) Date: Mar. 25, 1997

[87] PCT Pub. No.: WO95/35156

PCT Pub. Date: Dec. 28, 1995

[30] Foreign Application Priority Data

Jun. 17, 1994 [AT] Austria ..... 1208/94

[51] Int. Cl.[6] ..... B01F 3/04

[52] U.S. Cl. ..... 261/122.2; 261/DIG. 47

[58] Field of Search ..... 261/122.2, DIG. 47

[56] References Cited

U.S. PATENT DOCUMENTS

| | | | |
|---|---|---|---|
| 3,432,154 | 3/1969 | Danjes | 261/122.2 |
| 3,738,628 | 6/1973 | Nechine | 261/DIG. 47 |
| 4,048,267 | 9/1977 | Walker et al. | 261/DIG. 47 |
| 4,060,486 | 11/1977 | Schreiber | 261/122.2 |
| 4,818,446 | 4/1989 | Schreiber et al. | 261/122.2 |
| 4,929,397 | 5/1990 | Jager | 261/122.2 |
| 5,013,493 | 5/1991 | Tharp | 261/122.2 |
| 5,330,688 | 7/1994 | Downs | 261/122.2 |
| 5,378,355 | 1/1995 | Winkler | 261/122.2 |

FOREIGN PATENT DOCUMENTS

| | | | |
|---|---|---|---|
| 0359698 | 4/1989 | European Pat. Off. . | |
| 1054305 | 2/1954 | France . | |
| 2101672 | 3/1972 | France . | |
| 3441731 | 5/1986 | Germany . | |
| 3624580 | 2/1988 | Germany | 261/122.2 |
| 3731998 | 4/1989 | Germany | 261/122.2 |
| 3810790 | 10/1989 | Germany . | |
| 4240300 | 6/1994 | Germany . | |

*Primary Examiner*—C. Scott Bushey
*Attorney, Agent, or Firm*—Ladas & Parry

[57] ABSTRACT

A device for introducing gases into liquids in the form of fine bubbles, especially for introducing air into waste water, which device (1) comprises gas distributors (2) consisting of a longitudinal chamber (20) covered by a porous foil (19) arranged beneath the liquid level and to which gas is fed through a supply duct (5) and emerges into the liquid through the foil in the form of fine bubbles. The gas distributors (2) are connected to supply pipes (5) each provided for a group of gas distributors (2). The gas distributors (2) have a base wall (18) of rigidly-stable material, preferably metal, forming one side of the chamber (20) covered with the porous foil (19). Furthermore, it is preferred that the gas distributors (2), in the direction of their longitudinal extension, are mounted on carriers **(7, 7*a*)** arranged on the bottom of a basin or container in which the liquid is present.

32 Claims, 7 Drawing Sheets

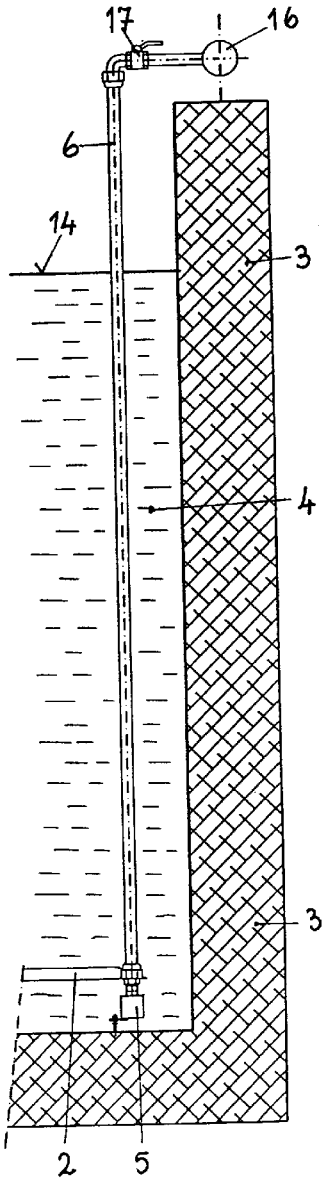
FIG. 9
FIG. 10
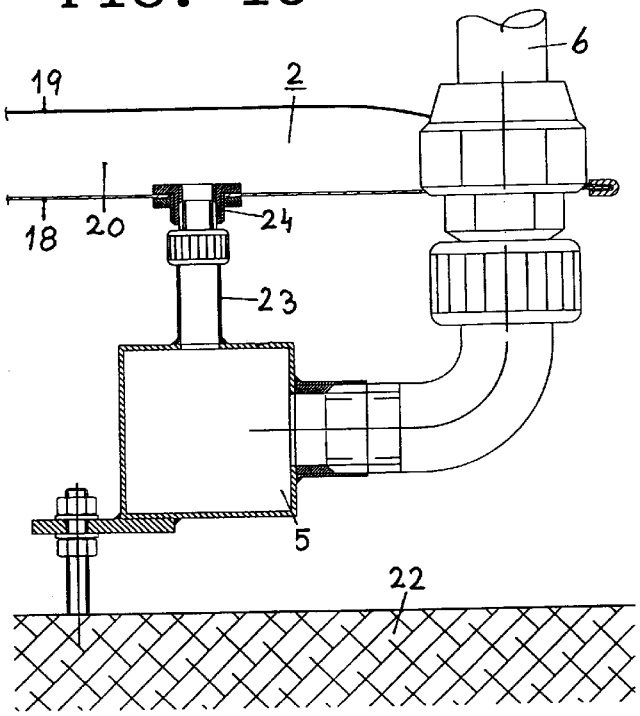
FIG. 11
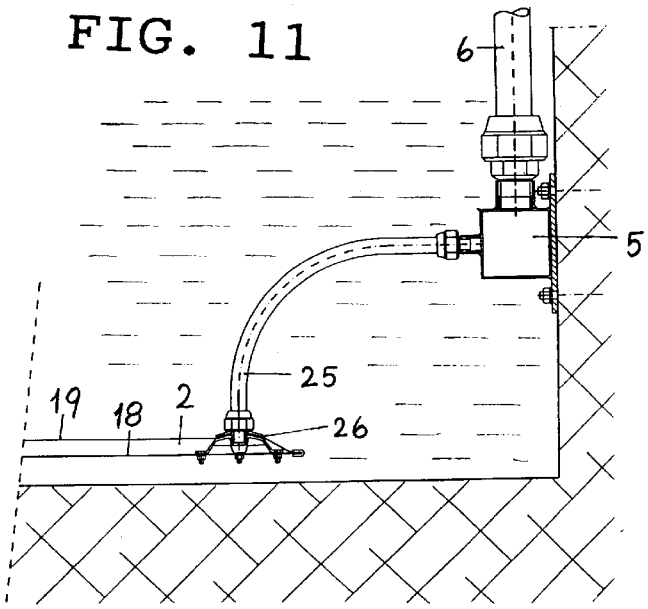

FIG. 12
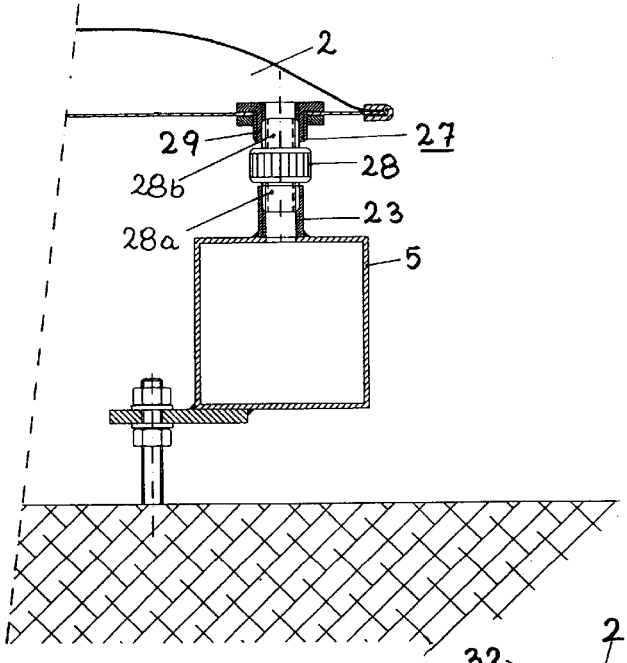
FIG. 14
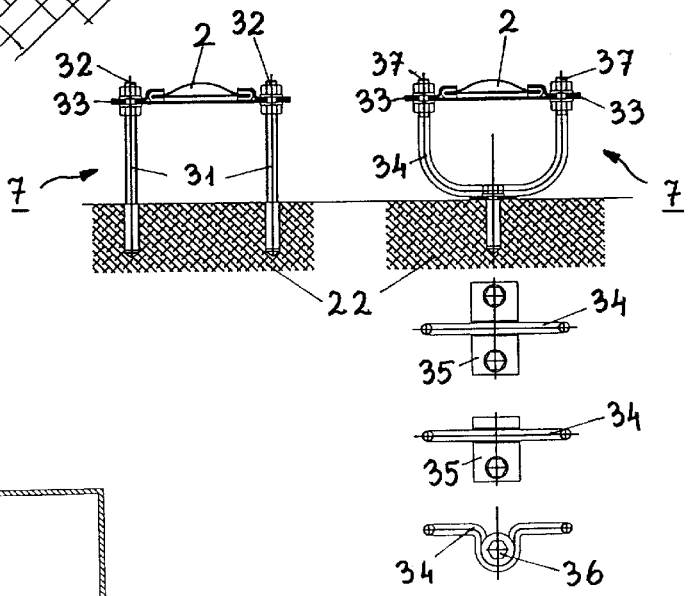
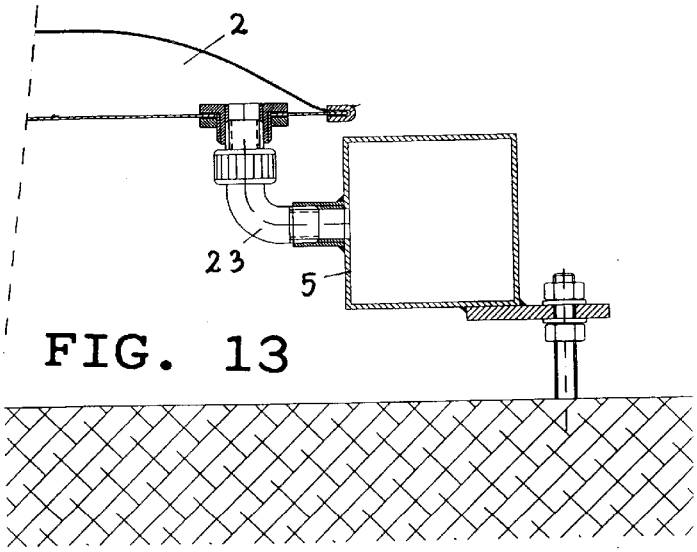
FIG. 13

DEVICE FOR INTRODUCING GASES INTO LIQUIDS IN FINE BUBBLES

FIELD OF THE INVENTION

The invention relates to a device for introducing gases into liquids in the form of fine bubbles, in particular for introducing air into waste water, which device comprises gas distributors consisting of a longitudinal chamber covered with a porous foil and arranged below the surface of the liquid, and to which gas is fed via a supply pipe, which gas emerges into the liquid through the foil in the form of fine bubbles, the gas distributors being connected to supply pipes each intended for a group of gas distributors.

BACKGROUND OF THE INVENTION

Devices for introducing gases into liquids serve to admix the liquids with certain gases so as to initiate or aid biological and/or chemical processes in the liquids under participation of the gases introduced. Thus, the introduction of gases such as, e.g., oxygen or air, may serve to supply these gases to microorganisms present in the gas-treated liquid. The introduction of gases into a liquid may, however, also have the effect that substances present in the liquid change over into the gaseous phase and flow off; this occurs when blowing out carbonic acid or ammonia, e.g. The introduction of gases into liquids has various effects which, depending of the respective individual case, may be judged as advantageous or as disadvantageous. Thus, e.g., the motion of a liquid associated with the introduction of gases into the respective liquid, which motion is caused by the movement of the gas bubbles in the liquid, may be considered advantageous in some instances, because such a motion of the liquid counteracts the formation of deposits in the respective container or basin in which gases are introduced into the liquid. Frequently, it is also the aim to incorporate in a liquid as large a percentage of the gases introduced as possible; this is favorably influenced by as small a size of the gas bubbles introduced into the respective liquid as possible. An introduction of gases into liquids in the form of fine bubbles can be attained if the gases to be introduced are fed into the liquid through a porous foil submerged beneath the surface of the liquid into which the gases are to be introduced. This is particularly provided for biological sewage treatment plants, to introduce oxygen from air into the activated sludge mixture present in a treatment basin. Devices have been known with large-area gas distributors, and such a large-area configuration of the gas distributors leads to increased structural expenditures due to the provision of measures for supporting the porous foil against the internal pressure prevailing in the chambers of the gas distributors and required for the introduction of gas into the liquid, and if there are larger distances between individual, large-area gas distributors, there also occurs an non-uniform distribution of the introduction of the gas into the liquid, and from the non-uniform introduction of gas there also result currents within the liquid. Such currents may reduce the dwell time of the gas bubbles in the liquid, and, correspondingly, a smaller percentage of the gases introduced into the liquid is accommodated by the liquid. The above-mentioned wider distances between the individual gas distributors mostly result from the economically-based desire to get by with as small a total area of gas distributors as possible.

In a known device of the initially defined type, the gas distributors are designed in the form of a flat air hose consisting of an elastic material, in particular rubber, which is provided with a plurality of air outlet openings at its upper wall, one end of this hose being connected to an air supply duct, cantilevering from this connection site, rod-shaped carrying elements being slid into this hose, the carrying elements also cantilevering from this connection site at the air supply duct. This construction is structurally complex and, due to the design of the gas distributors and the cantilevering structure of the same, it is restricted to a relatively short longitudinal extension of the gas distributors, so that also in this instance, for economical reasons and so as not to make an access to the basin difficult due to a great number of air supply ducts, care must be taken to get by with a small overall area of gas distributors and to put up with greater distances between the air supply ducts, which, however, as mentioned before, will lead to a non-uniform distribution of the gas introduction into the liquid and the disadvantages entrained thereby.

SUMMARY OF THE INVENTION

It is an object of the present invention to provide a device of the initially defined type, by which the disadvantages occurring in known devices of this type and as mentioned before, will be eliminated, and which, with a simple construction that can be realized at comparatively low costs, enables the uptake of a high percentage of the gases introduced into the liquid, by this liquid; the device to be provided shall be easy to install and should also enable good accessibility of the gas distributors to carry out maintenance work. The device to be provided should be particularly suitable for use in biological sewage treatment plants, and in that case air will be introduced so as to supply oxygen to the activated sludge mixture.

The device configured according to the invention of the initially defined type is characterized in that the gas distributors have a base wall of rigidly stable material, preferably metal, forming one side of the chamber covered with the porous foil. By this configuration, the above-indicated aim can be achieved very well. Good fixation or support of the gas distributors can be achieved in a simple manner, and thus also a relatively great structural length of the gas distributors can be provided for, by which a uniform distribution of the gas introduced into the liquid can be achieved. This configuration is also advantageous both, for the production of the gas distributors provided in the device of the invention, and with a view to mounting of the same in a container or basin containing the liquid to be gas-treated. The distance between the gas distributors can be chosen in dependence on the requirements prevailing for the liquid to be gas-treated, and there results a high degree of effectiveness with which the gases introduced into the liquid are taken up by the liquid. By the arrangement of the gas distributors, a two-dimensional pattern of gas flow can be formed in the region of the rising gas bubbles and of the gas-treated liquid, which can be calculated quite well, so that the dimensioning of the gas-treating device can be effected with greater accuracy than has previously been the case.

In connection with the above-indicated configuration of the device according to the invention it is further preferred and particularly advantageous if the gas distributors, in the direction of their longitudinal extension, at least on one side thereof are mounted on carriers, which are arranged on the bottom of a basin or container in which the liquid is to be gas-treated. By this, a very stable installation of the device can be effected in a simple manner in a basin or in a container in which the liquid to be gas treated is present, even if the gas distributors have great structural lengths. In this connection, it is furthermore suitable if the carriers are designed as rods arranged to extend transversely to the longitudinal direction of the gas distributors and each connected to several gas distributors. Suitably, the gas distributors have a length of from 1 m to 8 m. There, it is particularly suitable if the mutual distance of neighbouring gas distributors of a group, measured from center to center, is chosen according to the relation $l/a>2.5$, l being the length of the gas distributors and a being their mutual distance.

The arrangement of the gas distributors with their carriers on the bottom of the basin or container will be feasible in a structurally simple embodiment if the carriers are fastened to the bottom of the basin or container. With a view to mounting of the device it is furthermore suitable if the supply pipe is a carrier for the gas distributors associated to this supply pipe. A variant which is advantageous for carrying out maintenance work is characterized in that the gas distributors together with the carriers, which are designed as rods, form a unit laid into the basin or the container and capable of being lifted out. It is structurally advantageous if the carriers designed as rods are assembled to a frame. Constructing the gas distributors together with their carriers as a unit capable of being lifted out makes it possible to remove this unit from the container in a simple manner before carrying out various cleaning and maintenance work on the basin or container, so that such work is no longer impeded by installations in the basin or container, respectively, and it is furthermore possible to provide maintenance service on the gas distributors, e.g., to exchange membranes, in easily accessible work places, where it is dry. The structural elements termed "rods" have the object of carrying and mechanically interconnecting a number of gas distributors; as long as this object is met, the design of these rods is of minor importance; the rods may have the most different cross-sectional shapes, solid rods or solid sections being just as usable as pipes or other hollow sections, angle sections, U-sections or the like. If necessary, also weight bodies may be provided to keep the above-mentioned units on the bottom, counteracting buoyancy.

For mounting of the device, in particular the gas distributors, and for enabling an exchange of the perforated foils of these gas distributors, it is furthermore advantageous if the carriers are connected with the base wall of the gas distributors. In this connection, it is suitable if pipe connections departing from the supply pipe are provided which enter into the base wall of the gas distributors.

To ensure a largely undisturbed operation even if disturbances or damage occurs on individual gas distributors of the device, it is advantageous if the supply pipes are individually connected with a gas main duct via supply ducts into which blocking means are inserted. An embodiment is structurally advantageous which is characterized in that the supply pipes are arranged below the surface of the liquid, and the blocking means and the gas main duct are arranged above the surface of the liquid.

As a rule, it is advantageous to arrange the gas distributors as far below the surface of the liquid as possible, because the dwell time of the gas bubbles in the liquid can be prolonged in this manner. For this, an embodiment is suitable which is characterised in that the gas distributors are arranged at a lower level than the supply pipes.

It is structurally particularly advantageous if the supply pipes are connected with the gas distributors via pipe or hose connections and connecting elements which enter into the gas distributors through the porous foil.

BRIEF DESCRIPTION OF THE DRAWINGS

The invention will now be further explained by way of examples and with reference to the schematic drawings. In the drawings.

FIG. 9 is a sectional representation of the configuration of that part of the device which serves for supplying the gas to the gas distributors, of a preferred embodiment of the device of the invention, FIGS. 10 to 13 show several embodiments of the region of the supply pipes and their connection to the gas distributors, as they are provided in various embodiments of the device according to the invetion, in section, FIG. 14 shows a few embodiments of carriers for the gas distributors.

DETAILED DESCRIPTION OF THE PREFERRED EMBODIMENTS

Figure 1:
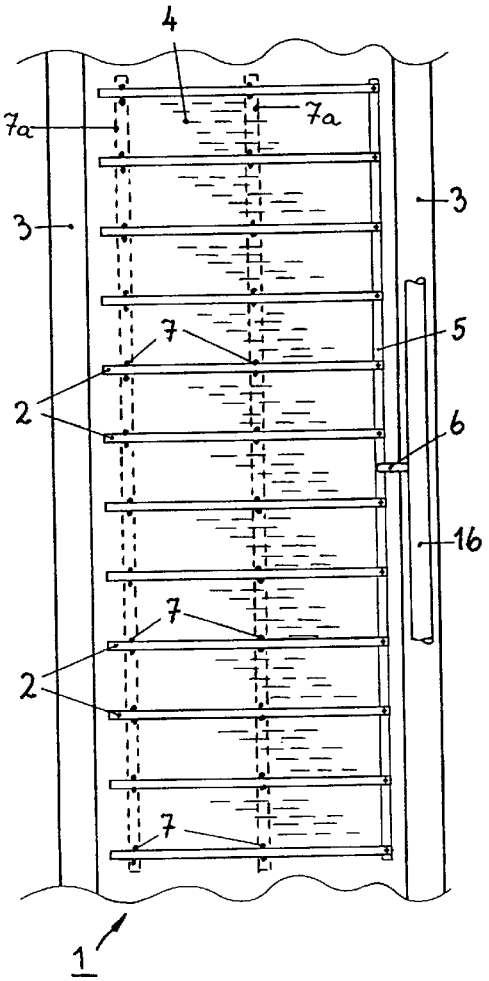
FIGS. 1 to 6 show different embodiments of a device according to the invention, partly portions thereof, in top view.

In the embodiment illustrated in FIG. 1 of a device 1 serving for introducing gases into liquid, gas distributors 2 are provided which are arranged below the surface of the liquid in a liquid 4 present in a container or basin 3. These gas distributors 2 are connected in groups to supply pipes 5 and are arranged approximately in parallel to each other. The supply pipes 5 extend approximately transversely to the gas distributors 2. In FIG. 1, for the benefit of a clear representation, only part of such a basin 3 is illustrated, with a group of gas distributors 2 connected to a supply pipe 5. The elongatedly configured gas distributors 2 whose construction will be explained in more detail later on, consist of a chamber covered by a porous foil, the gas to be introduced into the liquid 4 being supplied to said distributors via the supply pipes 5. The gas is supplied to the supply pipes 5 from a gas main duct 16 via supply ducts 6. Gas emerges in the form of fine bubbles from the gas distributors 2 through the above-mentioned porous foil into the liquid 4.

In the embodiment illustrated in FIG. 1, the gas distributors 2 belonging to one group are arranged to project from one side from the associated supply pipe 5. The gas distributors 2 are mounted on carriers 7 arranged on the bottom of the container or basin 3 in which the liquid 4 is gas-treated.

Such carriers 7 may each be associated to one individual gas distributor and may be provided with pins or the like which are fixed on the bottom of the respective container or basin 3. It is, however, also possible to provide carriers 7*a* which, as illustrated in broken lines in FIG. 1, each are connected with several gas distributors 2 and in turn are fixed on the bottom of the respectivce container or basin 3. Such carriers 7*a* may, e.g., have the form of section rods (angle sections, e.g.).

In practice, the gas distributors 2 may, e.g., be designed to have a width of from approximately 10 to 20 cm, and preferably having a length of at least approximately 1 m, typically from 3 to 4 m, and (particularly with a view to the transportation to be effected) having a maximum length of approximately 8 m, the width having a maximum value of approximately 40 to 50 cm. In the embodiment illustrated in FIG. 1, e.g., a length of the gas distributors 2 of approximately 3 m and a mutual distance of these gas distributors of approximately 75 cm may be assumed.

Figure 2:
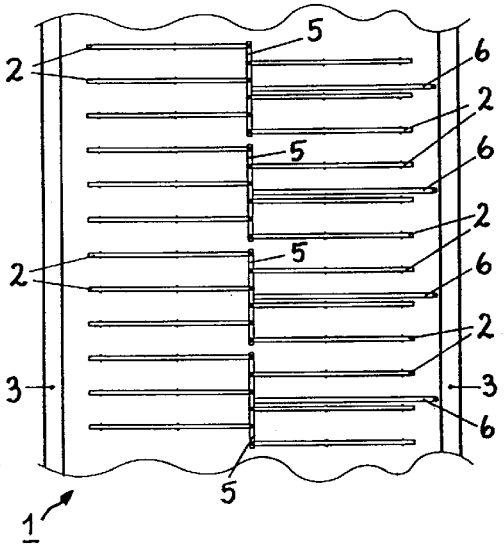
Figure 3:
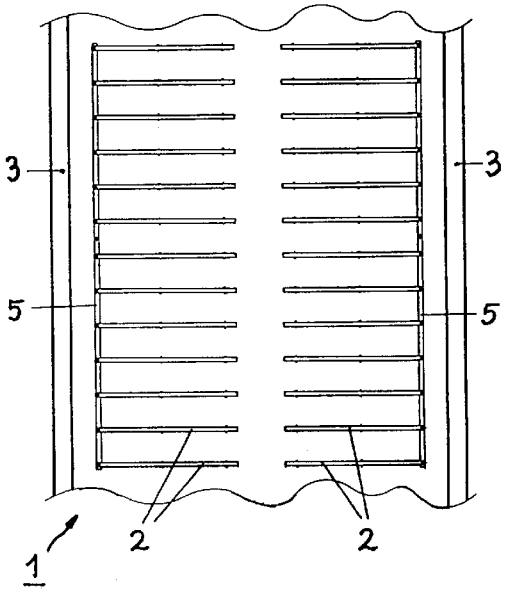
Figure 4:
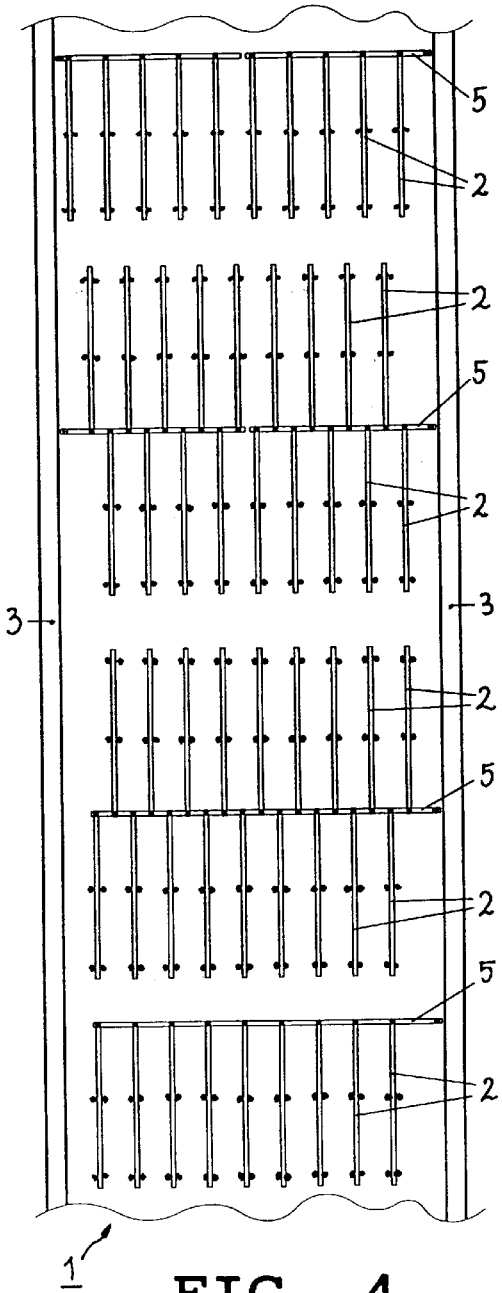

In case of larger basins in which liquids are to be gas-treated, it is often suitable to arrange the gas distributors 2 so as to project alternately in either direction from supply pipes 5, viewed in the longitudinal direction of these supply pipes, as is illustrated in FIG. 2. Thereinstead, and as it is the case in the embodiment illustrated in FIG. 3, it is also possible to arrange several groups of gas distributors 2 adjacently in a container or basin 3 containing the liquid to be gas-treated. Within the scope of a device, also both types of arrangement of the gas distributors 2 relative to the supply pipes 5 associated to the individual groups of such gas distributors may be used, i.e. both, groups of gas distributors 2 which are arranged to project from one side of the associated supply pipe 5, and groups of gas distributors 2 which are arranged to alternately project from either side of the supply pipe 5, as is the case in the embodiment of a device for introducing gases into liquid illustrated in FIG. 4.

As can be seen from FIGS. 10 to 13, the gas distributors 2 are constructed with a base wall 18 of rigid-stable material, preferably metal sheet, which forms one side of the chamber 20 covered by a porous foil 19. There, as is illustrated in these embodiments, the foil 19 is preferably fastened on the base wall by means of a clamping device 21 overlapping the rim of the base wall 18.

As regards the spatial arrangement of the supply pipes 5 provided at the individual groups of gas distributors 2, there is a great amount of freedom, and thus it is possible to meet the special requirements of a respective instance of installation without any problems. Thus, e.g., in containers or basins having a rectangular ground plan, the supply pipes 5 can be guided in parallel to the longitudinal sides of the basin ground plan, as is illustratd in FIGS. 1 to 3, or in parallel to the narrow sides, as can be seen from FIG. 4. The arrangement according to the invention may also be provided in containers or basins of circular, oval, elliptical or similar ground plan commonly often termed "round"; likewise, this device may be inserted for polygonal ground plans designed other than rectangular or square, or with an annular ground plan of the containers or basins. If required, the gas distributors belonging to one group may be designed to be differently long to correspond to the conditions given by the shape of the container or basin.

Figure 6:
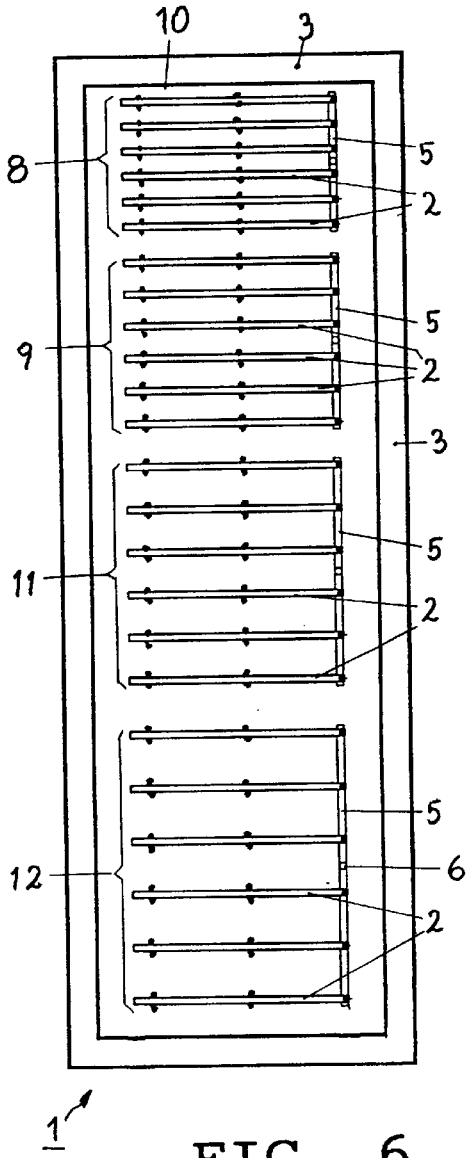
Figure 5:
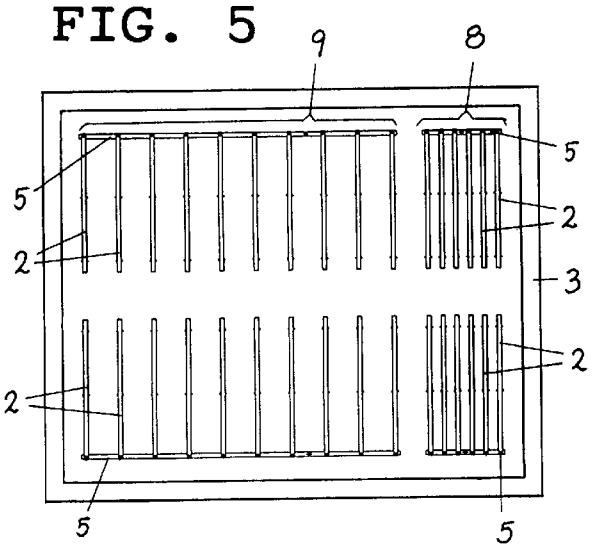

In the embodiments of the device according to the invention illustrated in FIGS. 1 to 4, the gas distributors 2 are arranged at equal mutual distances in the entire range illustrated in the individual Figures, so that gases are introduced uniformly distributed in this range into the liquids present in the respective devices 1 and into the containers or basins 3 thereof, respectively. On the other hand, however, it is also possible to chose the distances between the gas distributors 2 in the container or basin 3 of a device 1 to be different in different zones, as it is the case with the embodiment illustrated in FIG. 5, if in certain regions of the container or basin 3 of such a device 1, based on the surface unit of the container or basin 3, different amounts of gases are to be introduced into the liquid present in the container or basin 3. In the embodiment illustrated in FIG. 5, e.g., the mutual distance of the gas distributors 2 in the region 9 of the basin 3 is approximately 2½ times that of the mutual distance of the gas distributors 2 in the region 8 of the basin of this embodiment, and thus, in the region 8, based on the surface unit, approximately 2½ times the amount of gas is introduced into the liquid 4 present in the basin 3 as is in region 9. In this manner it is possible to adapt the gas introduction into the liquid to locally different requirements. In this connection, reference may also be made to the embodiment according to FIG. 6, which Figure shows a so-called plug flow reactor, in which the demand of gas to be introduced into the liquid continuously decreases from one end 10 of the basin 3 onwards; accordingly, the distances of the gas distributors 2 from each other, viewed from the end 10 of the basin 3 onwards, are selected to be increasingly wider in the individual regions 8, 9, 11, 12, and with an increasing distance of the gas distributors 2 from each other, the gas introduced, based on the surface area of the basin 3, decreases more and more with an increasing distance from the end 10 of the basin 3.

Figure 8:
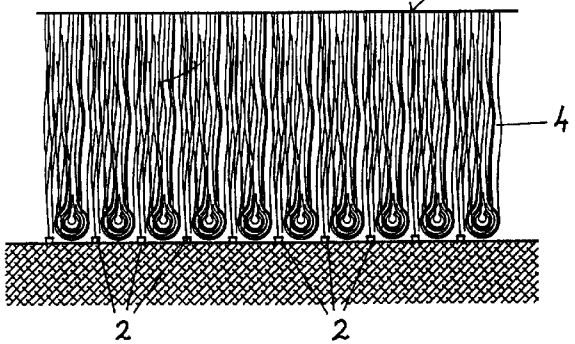
Figure 7:
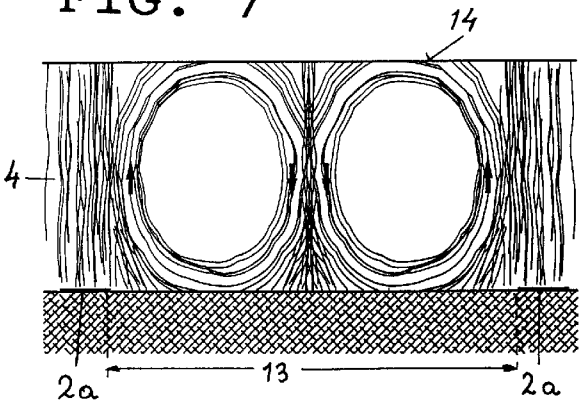
FIG. 7 schematically represents the flow pattern occurring in the liquid with a known device of the type discussed here, FIG. 8, in comparison thereto, shows the flow pattern resulting in the liquid with a device designed according to the invention, also in a schematical representation.

FIGS. 7 and 8 clarify the change in effect resulting from the inventive configuration of a device of the type discussed here when introducing gases into liquids in the form of fine bubbles. FIG. 7 illustrates how a roll-type flow results in the liquid 4 by the gas bubbles rising from the surface of the gas distributors 2*a* in the space between the individual adjacent gas distributors when using comparatively large-area gas distributors 2*a* arranged at a relatively large distance 13 from each other, which flow in turn has the effect that the small gas bubbles emerging from the gas distributors 2*a* very quickly get to the surface 14 or the level of the liquid 4, resulting in an unsatisfactorily slight utilization or uptake of the gas introduced into the liquid 4, by this liquid. On the other hand, in the inventive configuration of the device schematically illustrated in FIG. 8, (the porous foil having the same total surface as in the instance illustrated in FIG. 7), there is a clear improvement in the uptake of the gas introduced into the liquid by this liquid, because roll-like whirl movements in the liquid 4 occur only to a very limited extent in the immediate vicinity of the gas distributors 2 and in the region of the liquid 4 present thereabove, the small gas bubbles emerged from the porous foil of the gas distributors 2 migrate upwards slowly, and the long period of migration of the gas bubbles from their emergence from the gas distributors 2 until they have reached the surface 14 of the liquid 4 cause a considerably increased uptake of gas in the liquid, as compared to the known instance according to FIG. 7.

In the embodiment of those parts of the inventive device which serve for supplying the gas to the gas distributors and which are illustrated in FIG. 9, supply ducts 6 are provided, via which the supply pipes 5 are connected to a gas main duct 16. As has previously been explained, the supply pipes 5 in turn are connected with the gas distributors 2. A blocking means 17 is inserted in each supply duct 6 which leads from the supply pipe 5 of a group of gas distributors 2 to the gas main duct 16, and in this manner individual groups of gas distributors can be cut off selectively from the gas supply, e.g., if damage occurs on the gas distributors and/or maintenance or repair work must be carried out. In the embodiment illustrated, the supply pipes 5 are arranged below the surface 14 of the liquid, and the blocking means 17 and the gas main duct 16 are arranged above the surface of the liquid, i.e., in the instance illustrated in FIG. 9 easily accessibly at the upper rim of the side wall of basin 3 in which the liquid 4 to be gas-treated is present.

In the device according to the invention, if desired, a nonreturn means may be inserted at a suitable spot, e.g. in the connections of the gas distributors 2 with the supply pipes 5 so as to prevent liquid (water-activated sludge mixture in the case of a sewage treatment plant) from entering the gas supply system, if the gas supply is switched off. Such a measure is advantageous if the porous membrane provided in the respective case is permeable for the liquid.

With the embodiment illustrated in FIG. 10, the supply pipe 5 of a group of gas distributors 2 is fixed below these gas distributors on the bottom 22 of a container or basin, in which this device is arranged, and forms a carrier for the gas distributors 2 associated to this supply pipe 5. In this case, the gas distributors 2 and the supply pipes 5 are mechanically interconnected via connecting pipes 23 provided on the supply pipes 5 to project upwardly therefrom, and via connecting screw means 24 via which the connecting pipes 23 enter into the chamber 20 of the gas distributors 2 and which are mounted on the base wall 18 of the gas distributors 2, under simultaneous formation of a flow-through connection. Moreover, the gas distributors 2 are fixed in the basin containing the liquid to be gas-treated by means of further carriers 7, as will be further explained and as is also apparent from FIGS. 1 to 5. The connecting screw means 24 may advantageously be designed as clamping screw means which provide for a sealing connection to outwardly smooth connecting pipes 23.

In the embodiment illustrated in FIG. 11, the supply pipes 5, each of which is provided for a group of gas distributors 2, are mounted on the side wall of the basin containing the liquid 4 to be gas-treated, and the connection of the supply pipes 5 with the gas distributors 2, which serves to supply the gas to the gas distributors, is effected by pipe or hose connections 25; these pipe or hose connections 25 enter in bell-shaped connecting elements 26 fastened to the upper side of the base wall 18 of the gas distributors 2 and passing through suitable openings in the porous foil 19. There, the connecting elements 26 are designed in two parts, and the foil 19 is sealingly constrained between these two parts of the connecting elements. The embodiments illustrated in FIGS. 12 and 13 constitute variants to the embodiment according to FIG. 10 and differ from the latter as regards the design of the connecting screw means and the connecting pipes which lead from the supply pipes 5 to the gas distributors 2.

In the embodiment illustrated in FIG. 12, a connecting screw means 27 seated in the base wall is provided with a union nut 28 which is rotatably seated on a nipple 28*a* screwed into the connecting pipe 23, and which can be screwed onto a second nipple 28*b* screwed into the insert sleeve 29 (so-called "Hollander" screw connection) so that the connection of the gas distributors 2 with the supply pipes 5 and also the releasing of such a connection can be effected in a simple manner. Instead of such a "Hollander" screw connection, also a double nipple can be provided which has a left-handed thread and a right-handed thread and which can be screwed into threads correspondingly provided in the connecting pipe 23 and in the insert sleeve 29.

In the embodiment according to FIG. 13, the connecting pipes 23 entering into the gas distributors 2, i.e. in the base wall thereof, are designed as bent pipes laterally connected to the supply pipes 5, and thus it becomes possible to arrange the gas distributors 2 at a relatively low level relative to the supply pipes 5, which is often considered as advantageous.

FIG. 14 shows a few embodiments of carriers 7 by which the gas distributors 2 provided in the devices of the invention can be fastened to the floor 22 of a container or basin, in which the liquid to be gas-treated is present. In the embodiment of a carrier 7 illustrated at the left-hand side in FIG. 14, two stud bolts 31 fixed in the bottom 22 are provided, whose upper ends 32 carry the gas distributors 2. In the instance illustrated, the upper ends 32 of the stud bolts 31 are connected by brackets 33 retaining the gas distributors 2 downwardly and laterally surrounded. The brackets 33 in turn are screwed to the upper ends of the stud bolts 31. By modifying this concept, the gas distributors 2 may also be directly fixed on the stud bolts.

In the embodiment of a carrier 7 illustrated on the right-hand side in FIG. 14, a U-shaped bow 34 is provided whose center is fixed on the bottom 22. Such a fixation may, e.g., be effected by means of brackets 35 screwed to the bottom 22, or also by means of a screw 36 directly screwed into the bottom, with a respective configuration of the U-shaped bow, as is illustrated on the right-hand side of FIG. 14, at the bottom thereof. The gas distributors 2 are retained at the upper ends 37 of the U-shaped bow 34 by screw means, and, analogous to the example illustrated on the left-hand side in FIG. 14, brackets 33 may be provided to retain the gas distributors 2, or the gas distributors may be directly attached to the upper ends 37 of the U-shaped bow 34.

Figure 15:
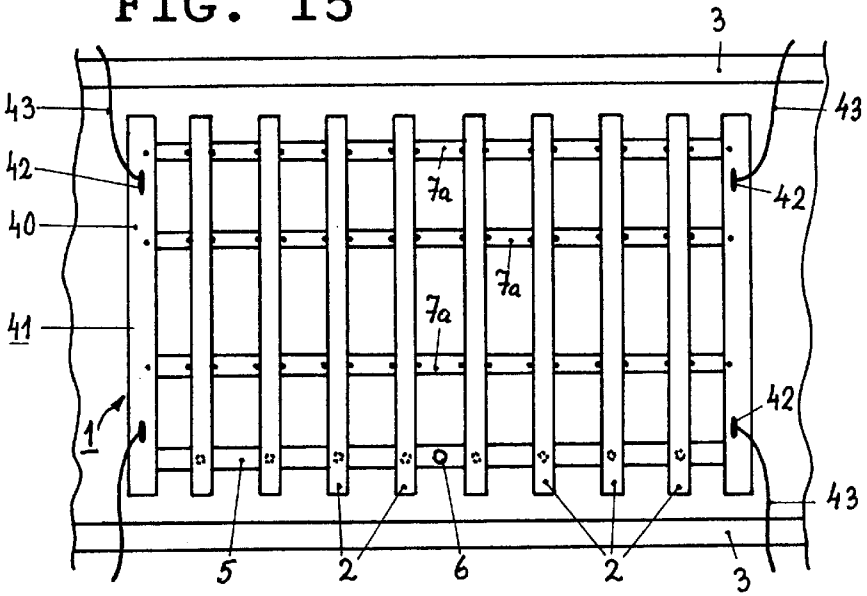
FIG. 15 is a top view on an embodiment of the device according to the invention, in which the gas distributors and the carriers form a unit capable of being lifted out.

FIG. 15 shows an embodiment of a device 1 according to the invention, which is laid into the container or basin 3 in a manner capable of being lifted out therefrom. The gas distributors 2 of this device 1, which are joined to the supply pipe 5, are connected with carriers 7*a* which are designed as rods and which, together with further section rods 40, form a frame 41. Advantageously, the carriers 7*a* and the section rods 40 may be designed as box-type sections filled with a weight means, e.g. lead, to counteract the buoyancy created by the gas content of the gas distributors and of the supply pipes. To lift out the device 1, advantageously eyes 42 are provided at suitable sites of the frame 41. By means of ropes 43 guided through these eyes 42 and extending to above the surface of the liquid, the device 1 can be lifted out in a simple manner by using a lifting device, such as, e.g., a crane. It is, of course, also possible to use chains, rods or the like to lift out this device.

Figure 16:
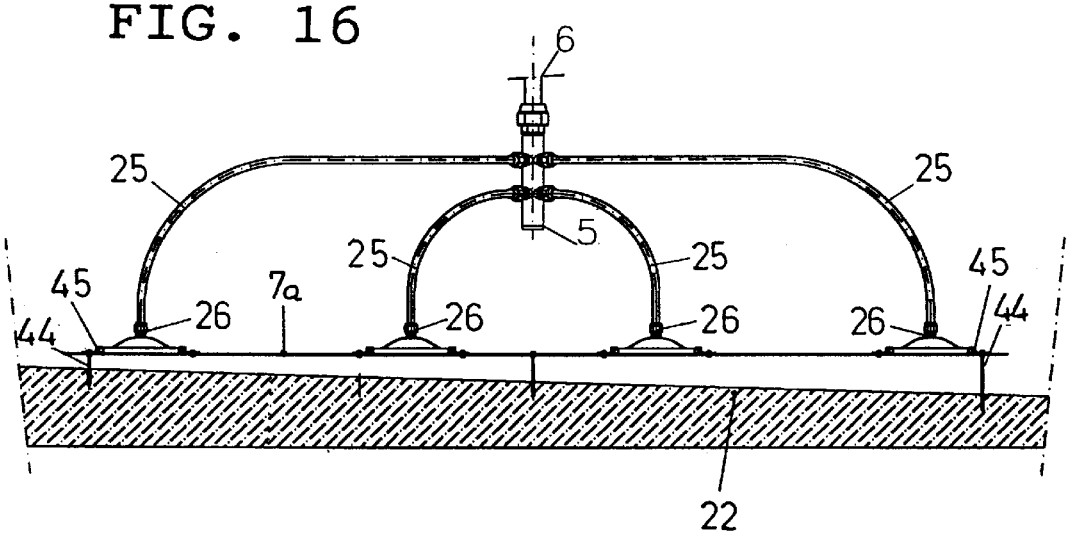
FIG. 16 is a further embodiment of the device, in side view.
Figure 17:
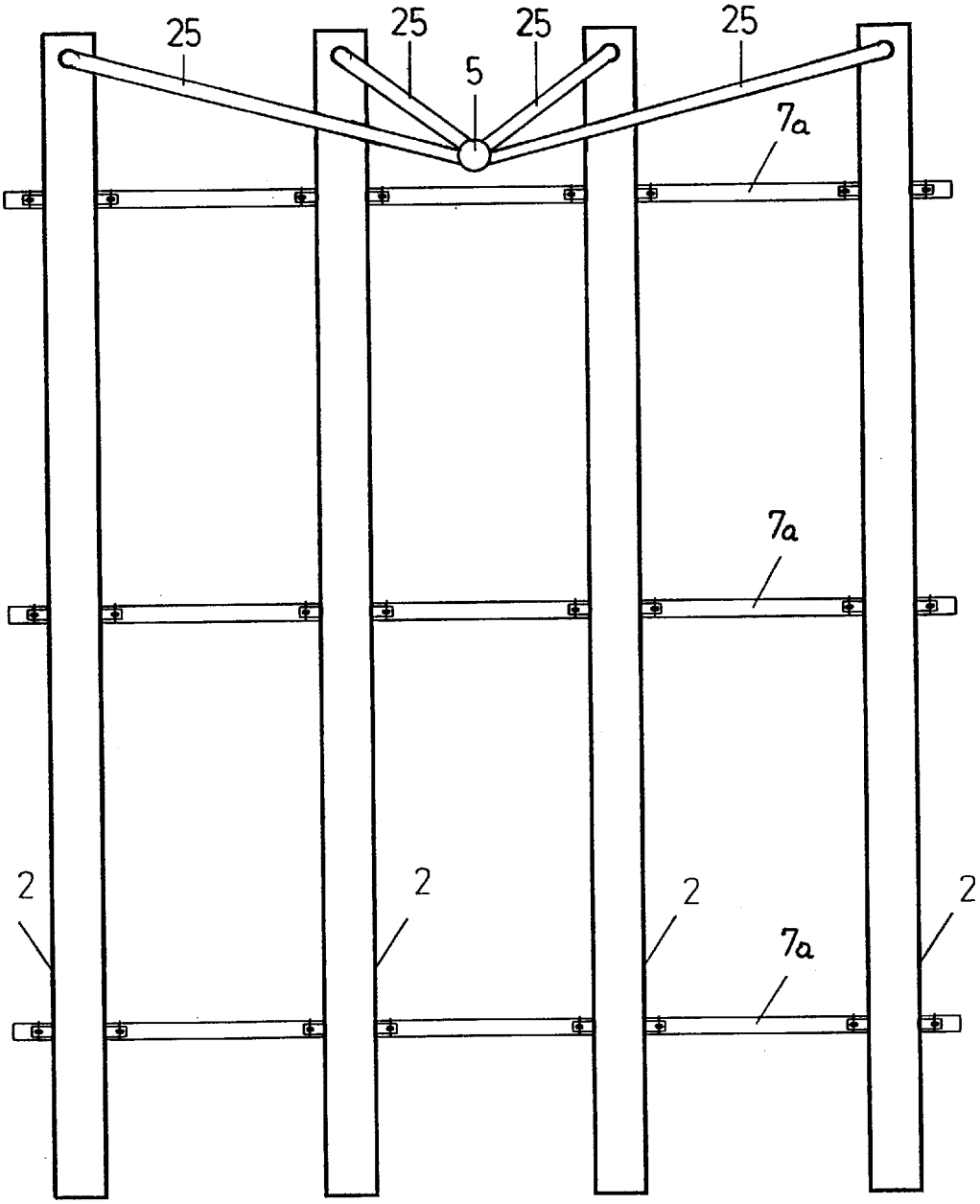
FIG. 17 shows this embodiment in top view.

FIGS. 16 and 17 are a side view and a top view of an embodiment of the device according to the invention, in which the gas distributors 2 are mounted on carriers 7*a* which are designed as rods extending transversely to the longitudinal extension of the gas distributors and arranged on the bottom 22 of the basin in which the device is inserted. In the instance illustrated, the carriers 7*a* are fixed to the bottom 22 by means of screws 44. Also different fixing elements, e.g. screw bolts, may be provided to attach the carriers 7*a*. The gas distributors 2 are retained on the carriers 7*a* by means of clamps 45; the clamps may be fixed to the carriers 7*a* by means of screws. Also as regards fastening of the gas distributors 2 to the carriers 7*a*, other constructional solutions may be provided. Supply to the gas distributors 2 is effected from supply pipes 5, which, as is apparent, may also be arranged to extend vertically, via pipe or hose connections 25 and connecting elements 26 entering into the gas distributors 2. In the instance illustrated, the connecting elements 26 enter into the gas distributors through the porous foil. Yet also an entry through the base wall of the gas distributors is feasible.

Figure 18:
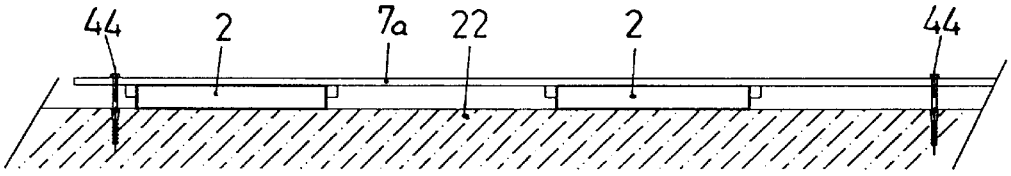
FIG. 18 is a side view of an embodiment with gas distributors lying on the bottom of the basin.

FIG. 18 shows an embodiment in which the gas distributors 2 are arranged to lie on the bottom 22 of the basin or container and are retained by rod-type carriers 7*a* arranged above the gas distributors 2, transversely to the longitudinal extension of the latter, and are fastened to the bottom 22. For this, screws 44, as illustrated, or other fastening means, such as, e.g., illustrated in FIG. 14, may be provided.

I claim:

1. A device for introducing gases into liquids in the form of fine bubbles, comprising elongate gas distributors each gas distributor having a width from 10 to 20 cm, each said gas distributor arranged below surface of the liquid, each gas distributor having a base wall of rigidly-stable material covered by a porous foil thereby forming an elongate chamber, supply pipes for supplying gas to the chambers, which gas, during operation, emerges through the foil into the liquid in the form of fine bubbles, each supply pipe being joined to at least one gas distributor wherein the supply pipe is connected with the chamber through a pipe or hose connection, said pipe or hose connection directly entering into the chamber through the porous foil wherein a connecting element of the pipe or hose connection is fastened to the base wall of the chamber.

2. A device according to claim 1, wherein the gas distributors are arranged at a lower level than the supply pipes.

3. A device according to claim 1, wherein at least one side of the gas distributor is mounted on a carrier, which is arranged on the bottom of a basin or container in which the liquid is to be gas-treated.

4. A device according to claim 3, wherein the carrier comprises rods arranged to extend transversely to the longitudinal direction of the gas distributors and each rod is connected to a plurality of gas distributors.

5. A device according to claim 1, wherein the gas distributors have a length of from 1 m to 8 m.

6. A device according to claim 5, wherein the mutual distance of neighbouring gas distributors of a group, measured from center to center, is chosen according to the relation $l/a>2.5$, l being the length of the gas distributors and a being their mutual distance.

7. A device according to claim 1, wherein the mutual distance of neighbouring gas distributors of a group, measured from center to center, is chosen according to the relation $l/a>2.5$, l being the length of the gas distributors and a being their mutual distance.

8. A device according to claim 3, wherein the carrier is fastened to the bottom of the basin or container.

9. A device according to claim 1, wherein the supply pipe is a carrier for the gas distributors associated to this supply pipe.

10. A device according to claim 3, wherein the gas distributors together with the carrier form a unit which can be lifted out from the basin or container.

11. A device according to claim 4, wherein the gas distributors together with the carrier form a unit which can be lifted out from the basin or container.

12. A device according to claim 4, wherein the rods are assembled to a frame.

13. A device according to claim 3, wherein the carrier is connected with the base wall of the gas distributor.

14. A device according to claim 1, wherein the supply pipes are individually connected to a gas main duct via supply ducts in which blocking means are inserted.

15. A device according to claim 14, wherein the supply pipes are arranged below the surface of the liquid, and the blocking means and the gas main duct are arranged above the surface of the liquid.

16. A device for introducing gases into liquids in the form of fine bubbles comprising elongate gas distributors each gas distributor having a width of from 10 to 20 cm, to be arranged below surface of the liquid, each gas distributor having a base wall of rigidly-stable material covered by a porous foil thereby forming an elongate chamber, supply pipes for supplying gas to the chambers, which gas, during operation, emerges through the foil into the liquid in the form of fine bubbles, each supply pipe being joined to at least one gas distributor wherein the supply pipe is connected with the chamber through a pipe or hose connection, said pipe or hose connection directly entering into the chamber wherein connecting elements of the pipe or hose connection enter into the base wall of the chamber.

17. A device according to claim 16, wherein the pipe or hose connection enter into the chamber through the porous foil.

18. A device according to claim 17, wherein connecting elements of the pipe or hose connection are fastened to the base wall of the chambers.

19. A device according to claim 16, wherein the gas distributors are arranged at a lower level than the supply pipes.

20. A device according to claim 16, wherein at least one side of the gas distributor is mounted on a carrier which is arranged on the bottom of a basin or container in which the liquid is to be gas-treated.

21. A device according to claim 20, wherein the carrier comprises rods arranged to extend transversely to the longitudinal direction of the gas distributors and each rod is connected to a plurality of gas distributors.

22. A device according to claim 16, wherein the gas distributors have a length of from 1 m to 8 m.

23. A device according to claim 16, wherein the mutual distance of neighbouring gas distributors of a group, measured from center to center, is chosen according to the relation $l/a>2.5$, l being the length of the gas distributors and a being their mutual distance.

24. A device according to claim 22, wherein the mutual distance of neighbouring gas distributors of a group, measured from center to center, is chosen according to the relation $l/a>2.5$, l being the length of the gas distributors and a being their mutual distance.

25. A device according to claim 20, wherein the carrier is fastened to the bottom of the basin or container.

26. A device according to claim 16, wherein the supply pipe is a carrier for the gas distributors associated to this supply pipe.

27. A device according to claim 20, wherein the gas distributors together with the carrier form a unit which can be lifted out from the basin or container.

28. A device according to claim 21, wherein the gas distributors together with the carrier form a unit which can be lifted out from the basin or container.

29. A device according to claim 21, wherein the rods are assembled to a frame.

30. A device according to claim 20, wherein the carrier is connected with the base wall of the gas distributor.

31. A device according to claim 16, wherein the supply pipes are individually connected to a gas main duct via supply ducts in which blocking means are inserted.

32. A device according to claim 31, wherein the supply pipes are arranged below the surface of the liquid, and the blocking means and the gas main duct are arranged above the surface of the liquid.

* * * * *